US006095437A

United States Patent [19]

Nozawa et al.

[11] Patent Number: 6,095,437

[45] Date of Patent: Aug. 1, 2000

[54] AIR-ASSISTED TYPE FUEL INJECTOR FOR ENGINES

[75] Inventors: Masaei Nozawa, Okazaki; Sigenori Isomura, Kariya; Yukio Sawada, Anjo, all of Japan

[73] Assignee: Denso Corporation, Japan

[21] Appl. No.: 09/236,646

[22] Filed: Jan. 26, 1999

[30] Foreign Application Priority Data

Jan. 26, 1998 [JP] Japan ..... 10-012658

[51] Int. Cl.[7] ..... B05B 7/12

[52] U.S. Cl. ..... 239/408; 239/407; 239/533.12; 239/533.14; 239/533.15

[58] Field of Search ..... 239/407, 408, 239/533.12, 533.14, 533.15

[56] References Cited

U.S. PATENT DOCUMENTS

| | | | |
|---|---|---|---|
| 4,982,716 | 1/1991 | Takeda et al. . | |
| 5,035,358 | 7/1991 | Katsuno et al. | 239/433 X |
| 5,218,943 | 6/1993 | Takeda et al. | 239/533.12 |
| 5,224,458 | 7/1993 | Okada et al. . | |
| 5,323,966 | 6/1994 | Buchholz et al. | 239/408 |
| 5,360,166 | 11/1994 | Nogi et al. | 239/408 X |
| 5,520,157 | 5/1996 | Pontoppidan | 239/533.12 X |
| 5,772,122 | 6/1998 | Sugiura et al. . | |
| 5,904,299 | 5/1999 | Hans et al. | 239/408 |
| 5,931,391 | 8/1999 | Tani et al. | 239/533.12 X |

FOREIGN PATENT DOCUMENTS

| | | | |
|---|---|---|---|
| 7-139449 | 5/1995 | Japan . | |
| 9-228931 | 9/1997 | Japan . | |
| 94/02736 | 2/1994 | WIPO | 239/533.12 |

*Primary Examiner*—Andres Kashnikow
*Assistant Examiner*—Robin O. Evans
*Attorney, Agent, or Firm*—Nixon & Vanderhye PC

[57] ABSTRACT

A fuel injector comprises an injector body and an air assisting adapter. The adapter is attached to the injector body and has a fuel passage for guiding spray of injected fuel. The fuel passage is divided into two directions. A plurality of air introduction holes are communicated with the fuel passage, so that pressurized air is introduced into the fuel passage to atomize the injected fuel. The air introduction holes open to the passage at a position where the particle size of the injected fuel starts to reduce. This position is 4 mm to 5 mm away in the downstream direction from an injection port plate of the injector body.

15 Claims, 7 Drawing Sheets

FIG. 4A
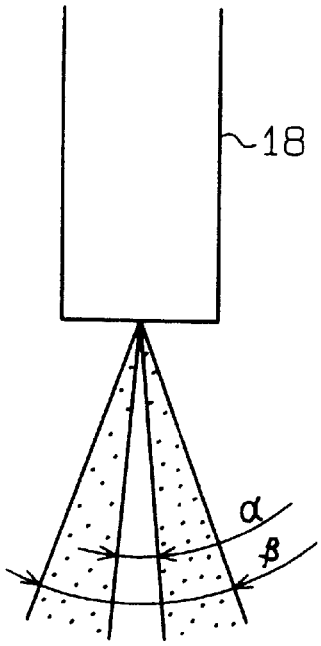
FIG. 4B
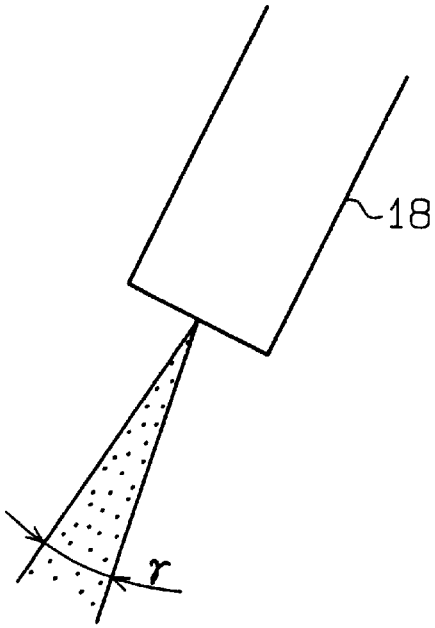
FIG. 5
| CONDITION | AIR PRESSURE | FUEL PARTICLE DIAMETER | SPRAY ANGLE | | |
|---|---|---|---|---|---|
| | | | α | β | γ |
| STARTING | 0 | 75μm | 10 | 39 | 15 |
| LOW LOAD OPERATION | 50kPa | 41μm | 9 | 40 | 18 |
| MEDIUM AND HIGH LOAD OPERATION | 100kPa | 26μm | 8 | 51 | 20 |

AIR-ASSISTED TYPE FUEL INJECTOR FOR ENGINES

CROSS REFERENCE TO RELATED APPLICATION

This application relates to and incorporates herein by reference Japanese Patent Application No. 10-12658 filed on Jan. 26, 1998.

BACKGROUND OF THE INVENTION

1. Field of the Invention

The present invention relates to an air-assisted type fuel injector for engines, and more particularly to a fuel injector that atomizes injected fuel with pressurized air.

2. Related Art

It is proposed to atomize spray fuel injected from a fuel injector, so that air-fuel mixture combustion in an engine is stabilized and unburned hydrocarbon (HC) in the exhaust gas is reduced. For instance, multiple fine holes are provided in the injection port of the fuel injector to atomize the injected fuel. In this type of injector, the fuel atomization is effected by thinning the flow line of fuel injected through each of the fine holes. However, the fuel atomization is lessened because of reunification of fuel particles, when the fuel flow lines crosses each other.

It is also proposed to construct a fuel injector as an air-assisted type. This type of injector introduces pressurized air into an injection port of a fuel injector so that the pressurized air hits the fuel spray, thereby promoting fuel atomization. The atomization may be changed by varying the pressure or amount of pressurized air.

SUMMARY OF THE INVENTION

It is an object of the present invention to improve an air-assisted type fuel injector.

It is another object of the present invention to enhance atomization efficiency of fuel injected from an air-assisted type fuel injector.

According to the present invention, a fuel injector is comprised of an injector body and an air assisting adapter. The adapter is attached to the injector body and has a fuel passage for guiding spray of injected fuel. The fuel passage is divided into two directions. A plurality of air introduction holes are communicated with the fuel passage, so that pressurized air is introduced into the fuel passage to atomize the injected fuel. The air introduction holes open to the passage at a position where the particle size of the injected fuel starts to reduce. The air introduction holes open to the fuel passage at a position which is 4 mm to 5 mm away in the downstream direction from an injection port plate of the injector body.

Preferably, the position of the introduction holes is within 2 mm in the upstream direction and in the downstream direction from a dividing point of a fuel divider member, which is provided in the adapter to divide the injected fuel into two directions, that is, toward two intake valves of each cylinder of an engine.

Still preferably, each air introduction hole opens to the fuel passage to face another air introduction hole in a radial direction.

BRIEF DESCRIPTION OF THE DRAWINGS

Other objects, features and advantages of the present invention will become more apparent from the following detailed description made with reference to the accompanying drawings. In the drawings:

FIGS. 4A and 4B are schematic views showing fuel spray angles formed by the fuel injector of the embodiment;

FIG. 5 is a table showing a relation among engine condition, air pressure, fuel particle diameter SMD and fuel spray angle of the fuel injector of the embodiment;

DETAILED DESCRIPTION OF THE PREFERRED EMBODIMENT

Figure 1:
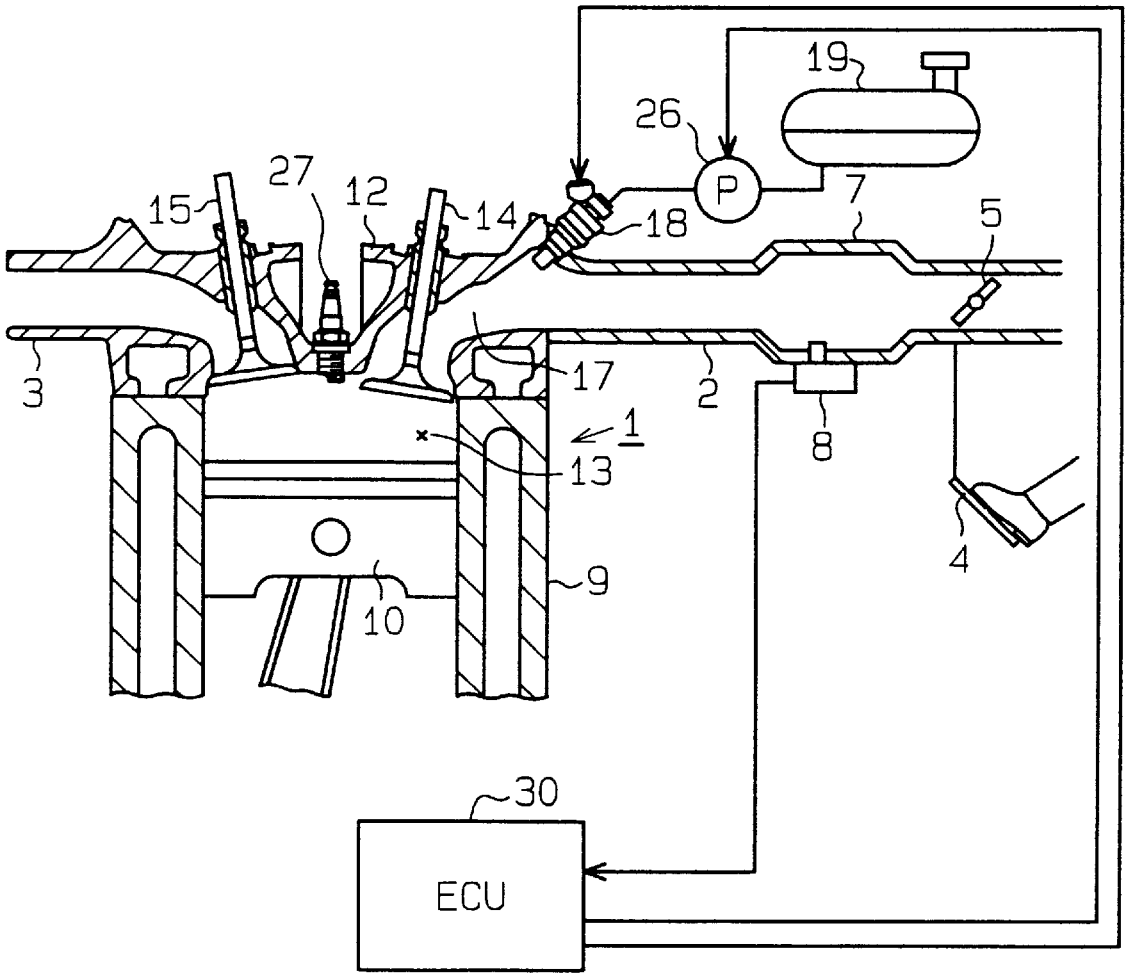
FIG. 1 is a schematic view showing a fuel injection system for engines.

Referring first to FIG. 1, an internal combustion engine 1 is a four-cylinder, four-cycle type having an intake pipe 2 and an exhaust pipe 3. The intake pipe 2 has a throttle valve 5, which is linked with an accelerator pedal 4. The intake pipe 2 also has a surge tank 7, to which a pressure sensor 8 is mounted. The engine 1 has cylinders 9, in each of which a piston 10 is provided reciprocally. A combustion chamber 13 is defined by the cylinder 9, piston 10 and a cylinder head 12. Each combustion chamber 13 is in communication with the intake pipe 2 and the exhaust pipe 3 through intake valves 14 and exhaust valves 15, respectively.

An electro-magnetically operated fuel injector 18 is mounted on each intake port 17 of the engine 1 to inject gasoline fuel supplied form a fuel tank 19 through a fuel pump 26. The fuel injector 18 is an air-assisted type having multiple injection holes. The injected fuel is mixed in the intake port 17 with the fresh air supplied through the intake pipe 2. The air-fuel mixture flows into the combustion chamber 13 when the intake valves 14 open, and is ignited by a spark plug 27 mounted on the cylinder head 12.

An electronic control unit (ECU) 30 is provided to control fuel injection operation of the fuel injector 18, fuel supply operation of the fuel pump 26, ignition operation of the spark plug 27, and the like in response to engine operating conditions such as intake air pressure detected by the pressure sensor 8 and engine rotation speed. The ECU 30 may be comprised of a CPU, ROM, RAM and input/output (I/O) interface circuit in the known manner.

Figure 2:
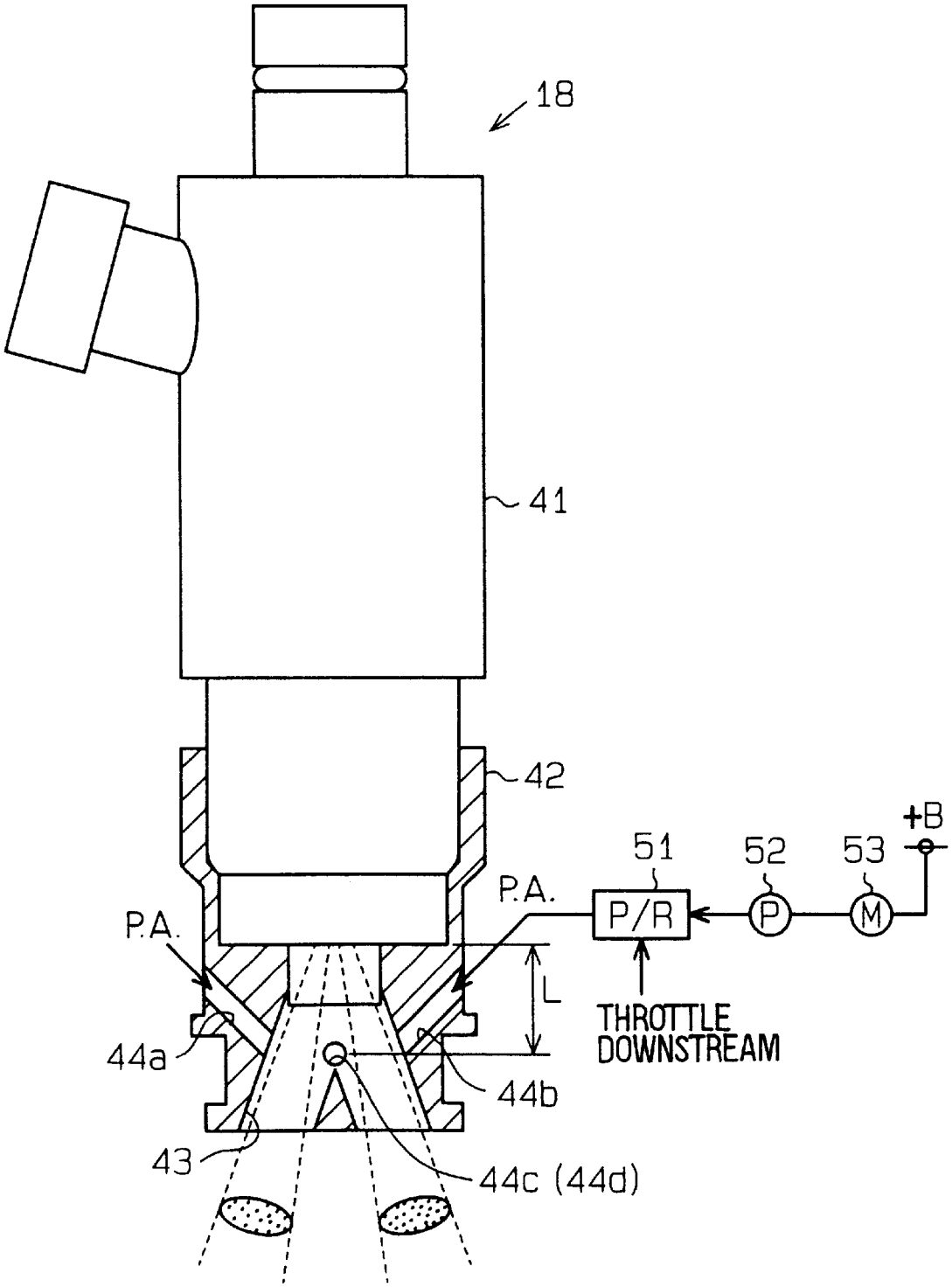
FIG. 2 is a side view showing an air-assisted type fuel injector according to an embodiment of the present invention.
Figure 3A:
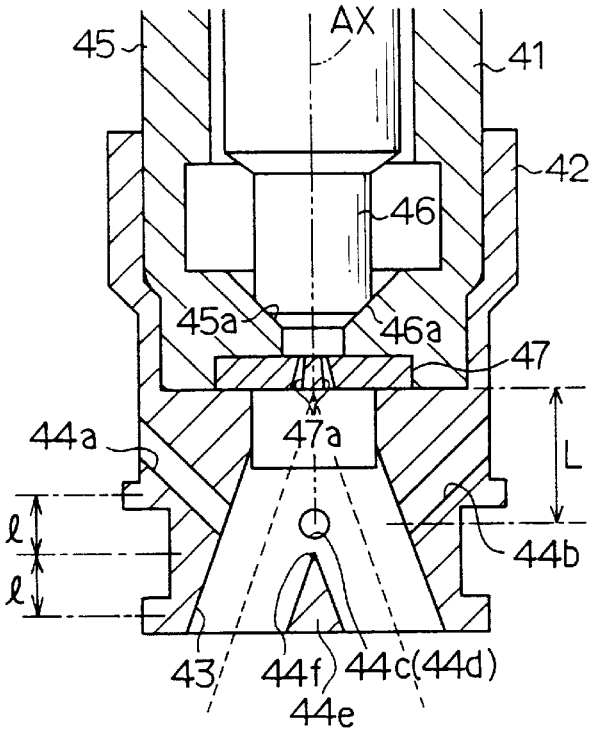
FIGS. 3A and 3B are partial sectional views showing front and side bottom end parts of the fuel injector of the embodiment.
Figure 3B:
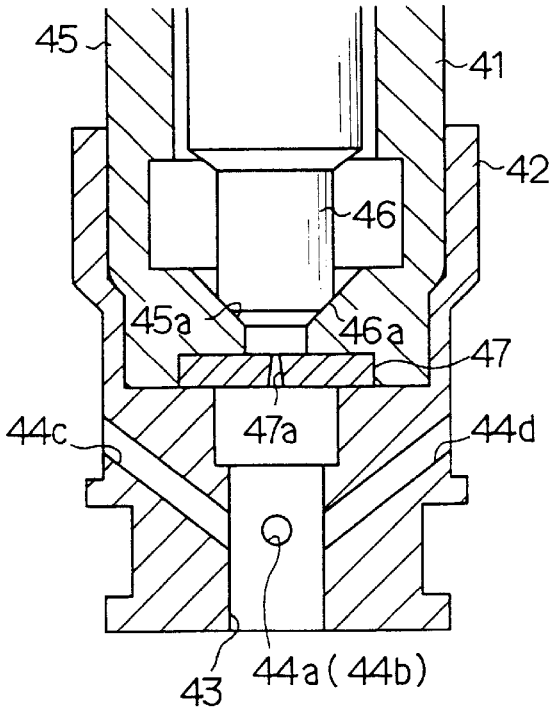

As shown in FIGS. 2, 3A, 3B, the fuel injector 18 is constructed as a two-jet injection type, which directs fuel spray into two directions, that is, toward two intake valves 14 in each intake port 17. The fuel injector 18 has an injector body 41 and an air-assisting adapter 42. A valve body 45 of the injector body 41 has a cylindrical shape, and accommodates therein a needle valve 46. The needle valve 46 has an abutment part 46*a*, which abuts a valve seat 45*a* of the valve body 45. The needle valve 46 is movable between the valve closure position (FIGS. 3A, 3B), in which the abutment part 46*a* abuts the valve seat 45*a* to close the injection port, and the valve open position (not shown), in which the abutment part 46*a* is moved away from the valve seat 45*a* to open the injection port.

An injection port plate 47 is fixed to the bottom of the valve body 45. The plate 47 has multiple (ten, for instance) fine holes 47*a*, and are arranged around the radially central axis AX so that the injected fuel forms a generally conical fuel spray shape.

The adapter 42 is attached to the bottom end part of the injector body 41, and has a fuel passage 43 to guide the spray of injected fuel therethrough. The fuel passage 43 is divided into two by a divider member 44*e*, which is triangular in section. The fuel passage 43 is in communication with a plurality of air introduction holes 44 (44*a*, 44*b*, 44*c*, 44*d*) at its midway, so that pressurized air is supplied into the fuel passage 43 for atomization of injected fuel.

Specifically, the air introduction holes 44 are arranged at regular angular intervals (90°) in the circumferential direction. The air introduction holes 44 are in communication with the fuel passage 43 at a position a predetermined distance (L) away from the plate 47, and within a range of distance (l) from a fuel dividing point 44*f* of the divider member 44*e* in both the upstream and downstream directions. Thus, the air introduction holes 44 are positioned to surround the fuel sprays, which are directed into two directions, from the upper and lower sides and from the right and left sides. The pressurized air is supplied in a forward direction of fuel injection, that is, in a direction to speed up the flow of the injected fuel.

Figure 6:
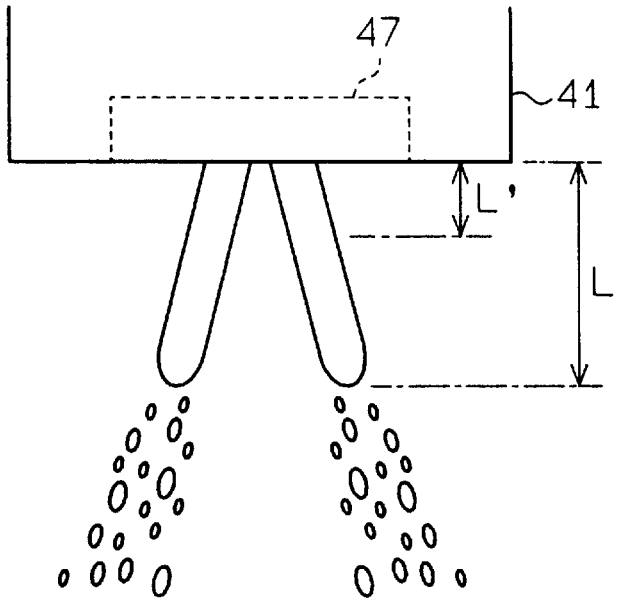
FIG. 6 is a schematic view showing fuel atomization at the downstream side of a fuel injector body in the embodiment.

As shown in FIG. 6, the fuel injected from the injector body 41 is divided at the point, which is the predetermined distance (L) away from the plate 47, and is atomized at the downstream side of this point. Accordingly, the air introduction holes 44 open to the fuel passage 43 at the fuel dividing point. This distance (L) may be between 2 mm and 10 mm, preferably between 4 mm and 5 mm. The distance (l) may be preferably about 2 mm, so that the divided fuel can be atomized effectively. In this embodiment, the pressurized air supplied from the introduction holes 44*a*, 44*b* opposing in the radial direction directly hits the fuel spray to promote the fuel atomization the fuel dividing point. The pressurized air supplied from the introduction holes 44*c*, 44*d* assists division of the fuel spray.

The fuel passage 43 expands from the radial center part of the injector body 41 toward the downstream side a predetermined angle. This angle is generally the same angle as that of the fuel spray provided when no air assisting is performed. Provided that the injection pattern of fuel of the fuel injector is defined as angles α, β, γ as shown in FIGS. 4A, 4B, the angle of the fuel passage 43 is preferably the same as the angle β, for instance 39°. Here, the angles α, γ of the fuel spray are preferably 10° and 15° as shown in FIG. 5, when no air assisting is performed in engine starting operation.

As shown in FIG. 2, the air introduction holes 44 of the adapter 42 are connected to an air supply passage, in which a pressure regulator 51 and an air supply pump 52 driven by an electric motor 53 are provided. The pressure regulator 51 is for regulating the pressure of air pressurized by the air supply pump 52 and supplied to the air introduction holes 44. Specifically, the air pressure is regulated to a pressure proportional to the pressure present in the throttle downstream side in the intake pipe 2.

As the pressurized air having the predetermined pressure difference relative to the throttle downstream vacuum pressure is supplied through the air introduction holes 44, the fuel injected into the spray form from the injector body 41 is promoted. It is preferred in this embodiment that the air is regulated between 0 kPa and 100 kPa and supplied into the fuel passage 43 continuously or intermittently.

In this embodiment, the diameter of the fuel passage 43 is 2.6 mm, the diameter of each air introduction hole 44 is 0.8 mm, and the angle between each air introduction hole 44 and the central axis AX of the injector 18 is about 45°. The atomized fuel particle diameter (SMD: Sauter's mean diameter) is varied by varying the pressure of air supplied to the fuel passage 43 as shown in FIG. 5. For instance, SMD is 75 μm at the time of engine starting, in which the air supply pump 52 is stopped and the air pressure is 0. SMD is reduced by increasing the air pressure as the engine load increases. That is, in the low engine load condition, the SMD is reduced to 41 μm by regulating the pressure of air to about 50 kPa so that the spray defining angles α, β, γ are set to 9°, 40°, 18°, respectively. In the medium and high engine load condition, the SMD is reduced to 26 μm by regulating the pressure of air to about 100 kPa so that the spray defining angles α, β, γ are set to 8°, 51°, 20°, respectively.

Figure 7:
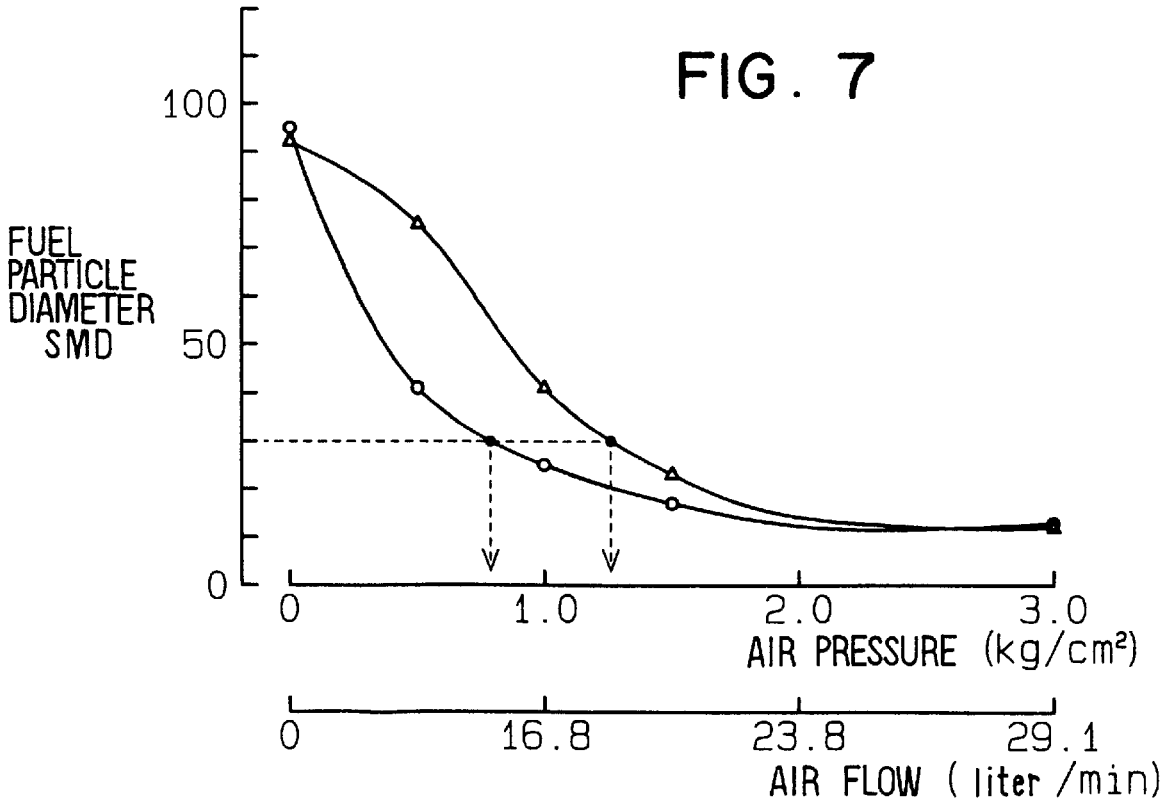
FIG. 7 is a graph showing a test result of fuel atomization of the fuel injector of the embodiment.

The above-constructed fuel injector 18 was tested to measure the atomized fuel particle diameter. The measurement result is shown in FIG. 7. In FIG. 7, the circular mark (○) shows the present embodiment, that is, the case in which the air introduction holes 44 are positioned at 4 mm downstream the plate 47, while the triangular mark (Δ) shows the case in which the air introduction holes 44 are positioned at 1.3 mm downstream the plate 47. As understood from this measurement, it was confirmed that the pressure or flow amount of the pressurized air can be set lower in the present embodiment (L=4 mm) indicated by the circular mark (○) than in the other case (L=1.3 mm) indicated by the triangular mark (Δ).

According to the above embodiment, the following advantages are provided.

(a) As the pressurized air is supplied to hit the fuel spray at the point downstream the fuel dividing point (L=4 mm), the fuel injected initially in the liquid form is atomized at the downstream of the dividing point. The atomization of the fuel spray is attained more effectively than in the case in which the pressurized air is supplied at the more upstream side (L=1 mm or 2 mm). Further, as the fuel particle is reduced initially by the multiple holes 47*a* of the plate 47, the fuel spray is atomized sufficiently by a smaller amount of pressurized air.

(b) As the air introduction holes 44 are directed generally in the forward direction, that is, in the fuel injection direction, the fuel spray pattern is not destroyed but can be maintained.

(c) As the air supply pump 52 is driven electrically, the air supply amount or pressure can be reduced to a necessary minimum, thereby reducing load of the motor 53 or a storage battery. Thus, no engine output power is necessitated for driving the air supply pump.

(d) As the adapter 42 is shaped to have the fuel passage 43 which has a passage diameter and extension direction so that the main stream of the fuel spray does not hit the passage wall at the time of no pressurized air supply, the fuel particle size can be maintained small enough even when the air supply pump 52 fails to operate.

The above embodiment may be modified as follows.

Figure 8A:
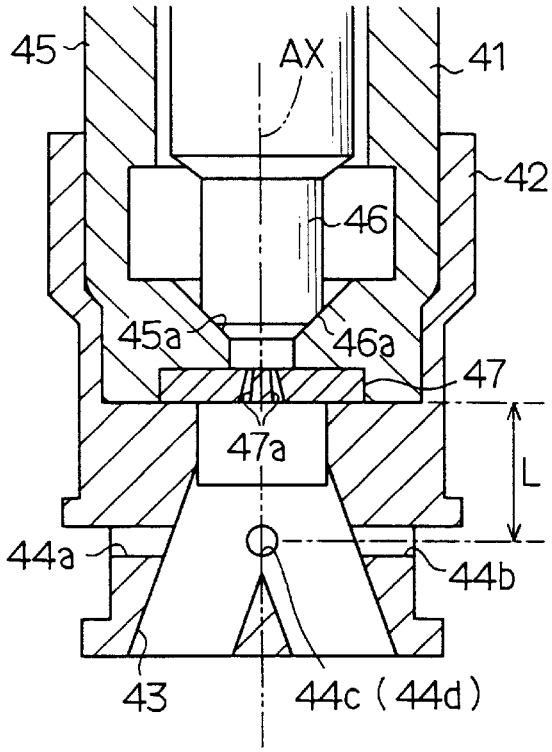
FIGS. 8A and 8B are partial sectional views showing front and side bottom end parts of an air-assisted type fuel injector according to a modification of the embodiment.
Figure 8B:
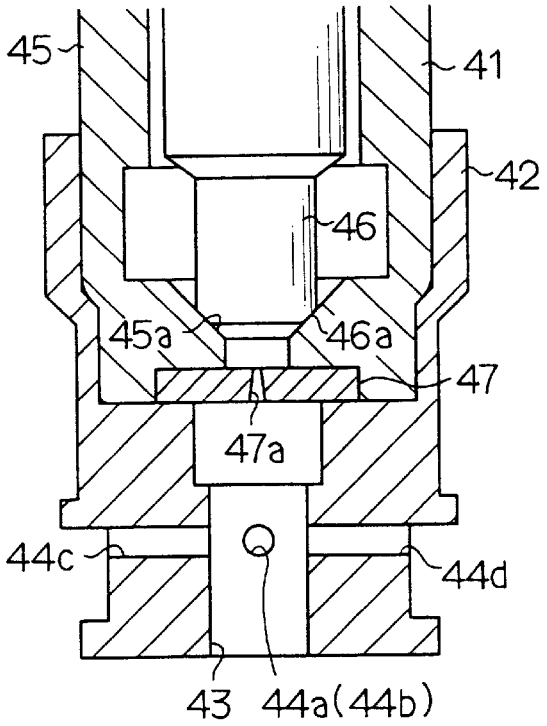

For instance, as shown in FIGS. 8A, 8B, the air introduction passages 44 (44*a* to 44*d*) may be provided perpendicularly to the central axis AX of the fuel injector 18 at the position about the predetermined distance (L=4 mm to 5 mm) away from the plate 47. In this modification, the adapter 42 can be machined easily to have the air introduction holes 44 therein.

Figure 9A:
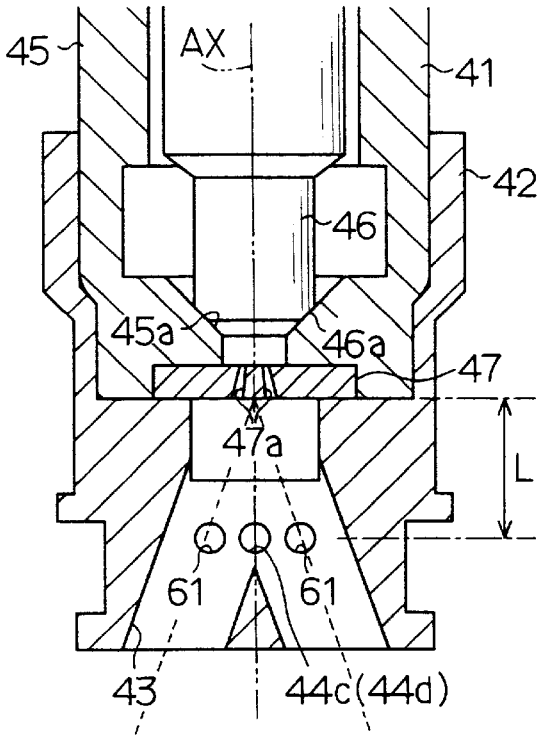
FIGS. 9A and 9B are partial sectional views showing front and side bottom end parts of an air-assisted type fuel injector according to another modification of the embodiment.
Figure 9B:
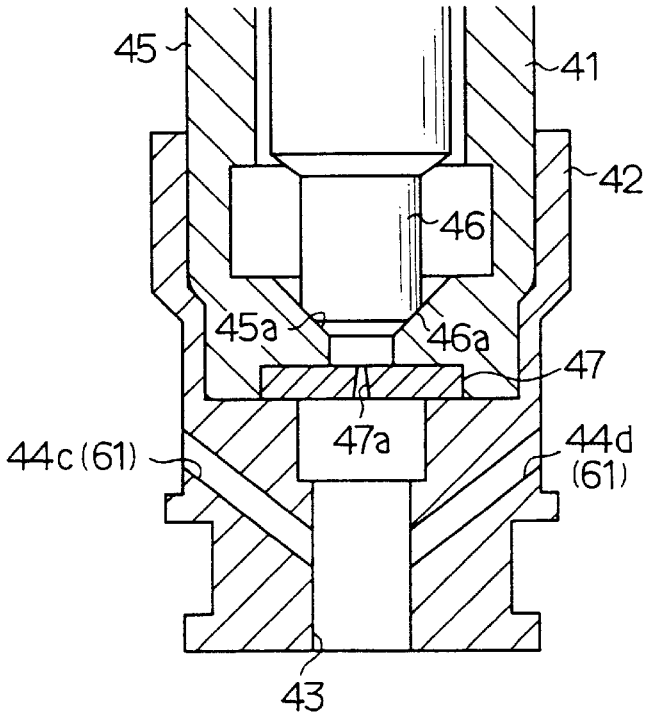

Further, as shown in FIGS. 9A, 9B, the adapter 42 may be shaped to have four air introduction holes 61 in place of two air introduction holes 44*a*, 44*b* (FIG. 3A) while having two air introduction holes 44*c*, 44*d* (FIG. 3B). That is, for each of the divided fuel spray, two air introduction holes 61 are provided to face each other, that is, at an angular interval of 180°. As shown in FIG. 9B, the air introduction holes 61 are arranged in parallel with the air introduction holes 44*c*, 44*d*. The air introduction holes 61 are directed to supply the pressurized air in the direction of fuel injection, while the air introduction holes 44*c*, 44*d* are directed to supply the pressurized air in the direction of the central axis AX of the injector 18. This arrangement is effective also to maintain the fuel spray pattern.

The diameter and direction of the fuel passage 43 may be modified, while ensuring that the main stream of the fuel spray does not hit the passage wall of the adapter 42. In this modification, it should be noted as shown in FIG. 5 that the angle° of fuel spray increases as the air pressure or air flow amount increases.

In the above embodiment and modifications, the air introduction holes 44*c*, 44*d*, which do not direct the pressurized air to hit the fuel spray directly, may be eliminated. The number of holes 47*a* of the plate may be different from ten and may be four, for instance. The fuel injector 18 need not be a two-jet type but may be a one-jet type, as long as at least one air introduction hole 44, 61 is provided at the position (L=4 mm to 5 mm) downstream the plate 47. If the number of air introduction holes 44, 61 are plural, each hole is positioned preferably to face another hole, that is, at the angular interval of 180° in the circumferential direction of the adapter 42. The air introduction holes 44, 61 may be provided to communicate the fuel passage 43 at other than L=4 mm to 5, as long as those are open to the fuel passage 43 at a position downstream the fuel dividing point. The atomization assisting air may be supplied by a differential pressure-driven type device, which supplies the air by the use of the pressure difference between the throttle upstream and downstream, in place of the electrically-driven device 52, 53, so that the amount of air for atomization can be reduced and deviation of air-fuel ratio at the engine transient condition can be minimized.

The present invention may be implemented in other ways without departing from the spirit and scope of the invention.

What is claimed is:

1. An air-assisted type fuel injector comprising:

an injector body for injecting fuel from an injection port thereof; and air-assisting adapter attached to the injector body and having a fuel passage for the injected fuel and an air introduction hole for supplying air into the fuel passage to atomize spray of the injected fuel, the air introduction hole opening at a position which is a predetermined distance away from the injection port and at which a size of particles of the injected fuel starts to reduce, said predetermined distance being about 4 to 5 mm from the injection port.

2. A fuel injector as in claim 1, further comprising:

an injection port plate disposed in the injection port and having multiple holes.

3. A fuel injector as in claim 1, wherein the air introduction hole is directed in a direction which is generally the same as a fuel injection direction of the injector body direction to the fuel injection direction.

4. A fuel injector as in claim 1, wherein the air introduction hole is directed perpendicularly to an axial direction of the injector body.

5. A fuel injector as in claim 1, wherein there are a plurality of air introduction holes provided at a plurality of positions to face each other in a radial direction.

6. A fuel injector as in claim 1, wherein the injector body is constructed to inject the fuel in two directions, and the adapter has a divider member which divides the fuel passage thereof in the two directions.

7. A fuel injector as in claim 6, wherein the air introduction passage opens to the fuel passage within 2 mm in a fuel upstream direction and 2 mm in fuel downstream direction from a fuel dividing point of the divider member.

8. A fuel injector as in claim 6, wherein the air introduction hole is provided to supply the air in a direction to sandwich the spray of fuel injected in the two directions from at least one of upstream/downstream sides and left/right sides.

9. A fuel injector as in claim 8, wherein the air introduction hole is directed in a forward direction of the fuel injection from the injector body.

10. A fuel injector as in claim 8, wherein the air introduction hole is directed in a perpendicular direction of the fuel injection from the inject or body.

11. A fuel injector as in claim 1 further comprising:

an air pump for pressurizing the air supplied to the air introduction hole.

12. A fuel injector as in claim 1, wherein the fuel passage has a diameter and direction so that a main stream of the injected fuel flows through the fuel passage without hitting walls of the fuel passage.

13. A fuel injector as in claim 11, wherein a pressure of the air supplied to the air introduction hole is regulated to the air introduction hole between 0 KPa and 100 KPa.

14. A fuel injector as in claim 11, further comprising a pressure regulator for regulating the pressure of air pressurized by the air supply pump and supplied to the air introduction hole.

15. A fuel injector as in claim 14, mounted to an intake port of an engine for injecting fuel for mixing with air supplied through an intake pipe and wherein the pressure regulator regulates the air pressure to a pressure proportional to the pressure present in the intake pipe.

* * * * *